US005777638A

United States Patent [19]

Salter et al.

[11] Patent Number: 5,777,638

[45] Date of Patent: Jul. 7, 1998

[54] PRINT MODE TO COMPENSATE FOR MICROBANDING

[75] Inventors: James G. Salter, San Diego; B. Michael Eckard, Cardiff, both of Calif.

[73] Assignee: Hewlett-Packard Company, Palo Alto, Calif.

[21] Appl. No.: 603,997

[22] Filed: Feb. 22, 1996

[51] Int. Cl.[6] ..... B41J 29/38; B41J 2/15

[52] U.S. Cl. ..... 347/12; 347/16; 347/40; 347/41

[58] Field of Search ..... 347/40, 41, 12, 347/13, 9, 16, 5, 19

[56] References Cited

U.S. PATENT DOCUMENTS 4,059,183 11/1977 Hoskins ..... 347/41 X 4,593,295 6/1986 Matsufuji et al. ..... 347/41

4,739,415 4/1988 Toyono et al. ..... 347/9 X 5,297,017 3/1994 Haselby et al. ..... 347/19

*Primary Examiner*—David F. Yockey

[57] ABSTRACT

A method for ink jet printing that includes the steps of determining an amount and direction of rotational misalignment of a left nozzle column and a right nozzle column of an ink jet printhead relative to a media advance axis; selecting one of the left nozzle column and the right nozzle column as a first to print nozzle column; determining a media advance correction to compensate the rotational misalignment; printing dots on a print media with the first to print nozzle column in a first carriage scan; moving the print media by the media advance correction; and printing dots on the print media with the other of the left nozzle column and the second nozzle column.

6 Claims, 10 Drawing Sheets

(LEFT FIRST) FIG.8B $MA = 2P - (D * TAN\ \theta_Z)$ (RIGHT FIRST) FIG.8C $MA = (D * TAN\ \theta_Z)$ $MA = (D * TAN\ \theta_Z)$ $MA = 2P - (D * TAN\ \theta_Z)$

PRINT MODE TO COMPENSATE FOR MICROBANDING

BACKGROUND OF THE INVENTION

The disclosed invention relates to ink jet printing devices, and more particularly to techniques for improving print quality.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

An ink jet printhead includes an array of nozzles through which droplets of ink are fired. The nozzles are commonly arranged in side by side columns that are aligned with the media axis, and the nozzles of one column are staggered along the media axis relative to the nozzles of the other columns in accordance with the print or dot resolution of the printhead. Thus, for the particular example of a two column nozzle array, the distance along the media axis between diagonally adjacent nozzles, which is also called the nozzle pitch, is equal to the resolution dot pitch of the desired dot resolution (e.g., 1/600 inch for 600 dpi). In use, the physical spacing between the columns of nozzles in a printhead is compensated by appropriate data shifts in the swath print data so that the two columns function as a single column of nozzles.

A consideration with implementing a multiple column nozzle array is the need for precise mechanical alignment of the columns with the media axis. If the columns of a nozzle array are positioned so as to be tilted or rotated relative to the media axis about an axis that is orthogonal to a plane that is parallel to the media axis and the carriage scan axis, the spacing between adjacent nozzles along the media axis will not be equal. In particular, the spacing between one nozzle and an adjacent nozzle in one direction along the media axis will be less than the dot resolution while the spacing between such nozzle and an adjacent nozzle in the other direction along the media axis will be greater than the dot resolution. The result is a printed output wherein the dots are misaligned along the carriage axis and along the media axis.

The misalignment along the carriage axis can be corrected by controlling the timing of the print pulses provided to the nozzles of a printhead.

However, the misalignment along the media axis, which results in non-uniform spacing between rows of dots that can be referred to as microbanding, cannot be corrected by processing of the swath data.

SUMMARY OF THE INVENTION

It would therefore be an advantage to provide a technique for compensating media axis alignment error caused by rotational misalignment of an ink jet printhead.

The foregoing and other advantages are provided by the invention in a method for ink jet printing that includes the steps of determining an amount and direction of rotational misalignment of a left nozzle column and a right nozzle column of a printhead relative to the media scan axis; selecting one of the left nozzle column and the right nozzle column as a first to print nozzle column; determining a media advance correction to compensate the rotational misalignment; printing dots on a print media with the first to print nozzle column in a first carriage scan; moving the print media by the media advance correction; and printing dots on the print media with the other of the left nozzle column and the right nozzle column.

BRIEF DESCRIPTION OF THE DRAWINGS

The advantages and features of the disclosed invention will readily be appreciated by persons skilled in the art from the following detailed description when read in conjunction with the drawing wherein:

FIG. 8B schematically sets forth a dot pattern that would be printed in accordance with the invention at a fixed position along the carriage axis by the nozzles of the counterclockwise misaligned nozzle array of FIG. 6.

FIG. 8C schematically sets forth another dot pattern that would be printed in accordance with the invention at a fixed position along the carriage axis by the nozzles of the counterclockwise misaligned nozzle array of FIG. 6.

DETAILED DESCRIPTION OF THE DISCLOSURE

Figure 1:
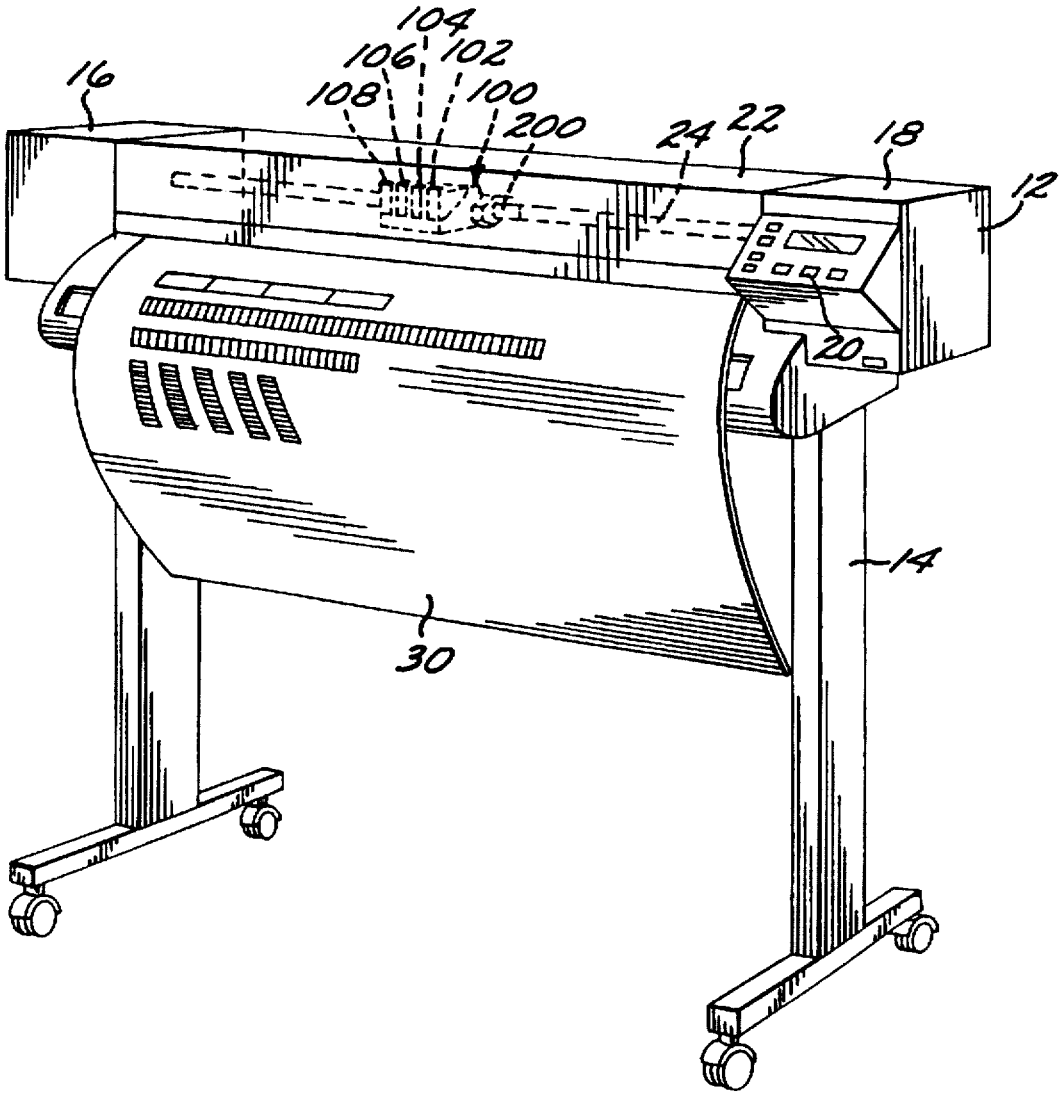
FIG. 1 is a perspective view of an ink jet large format printer/plotter incorporating the teachings of the present invention.

In the following detailed description and in the several figures of the drawing, like elements are identified with like reference numerals.

FIG. 1 is a perspective view of a thermal ink jet large format printer/plotter incorporating the teachings of the disclosed invention. The printer 10 includes a housing 12 mounted on a stand 14. The housing has left and right drive mechanism enclosures 16 and 18. A control panel 20 is mounted on the right enclosure 18. A carriage assembly 100, illustrated in phantom under a transparent cover 22, is adapted for reciprocal motion along a guide rail 24, also shown in phantom. The position of the carriage assembly 100 in a horizontal or carriage scan axis is determined by a carriage positioning mechanism 110 (FIG. 2) with respect to an encoder strip 120 (FIG. 2) as discussed more fully below with respect to FIG. 2. A print medium 30 such as paper is positioned along a vertical or media advance axis by a media axis drive mechanism that includes a print roller 154 (FIGS. 2 and 3).

Figure 2:
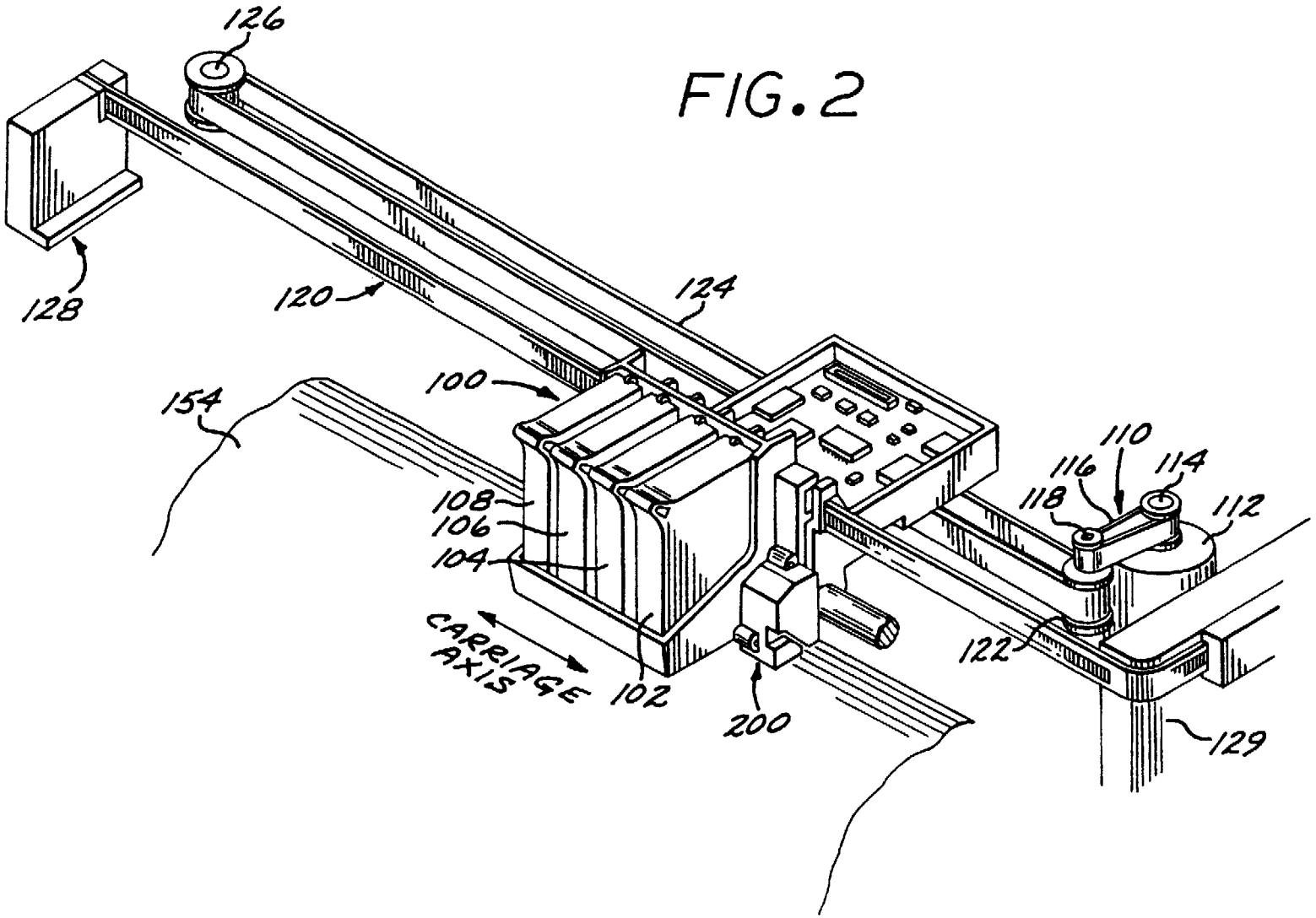
FIG. 2 is a perspective view of the carriage assembly, carriage positioning mechanism, and print media positioning mechanism of the printer/plotter of FIG. 1.
Figure 3:
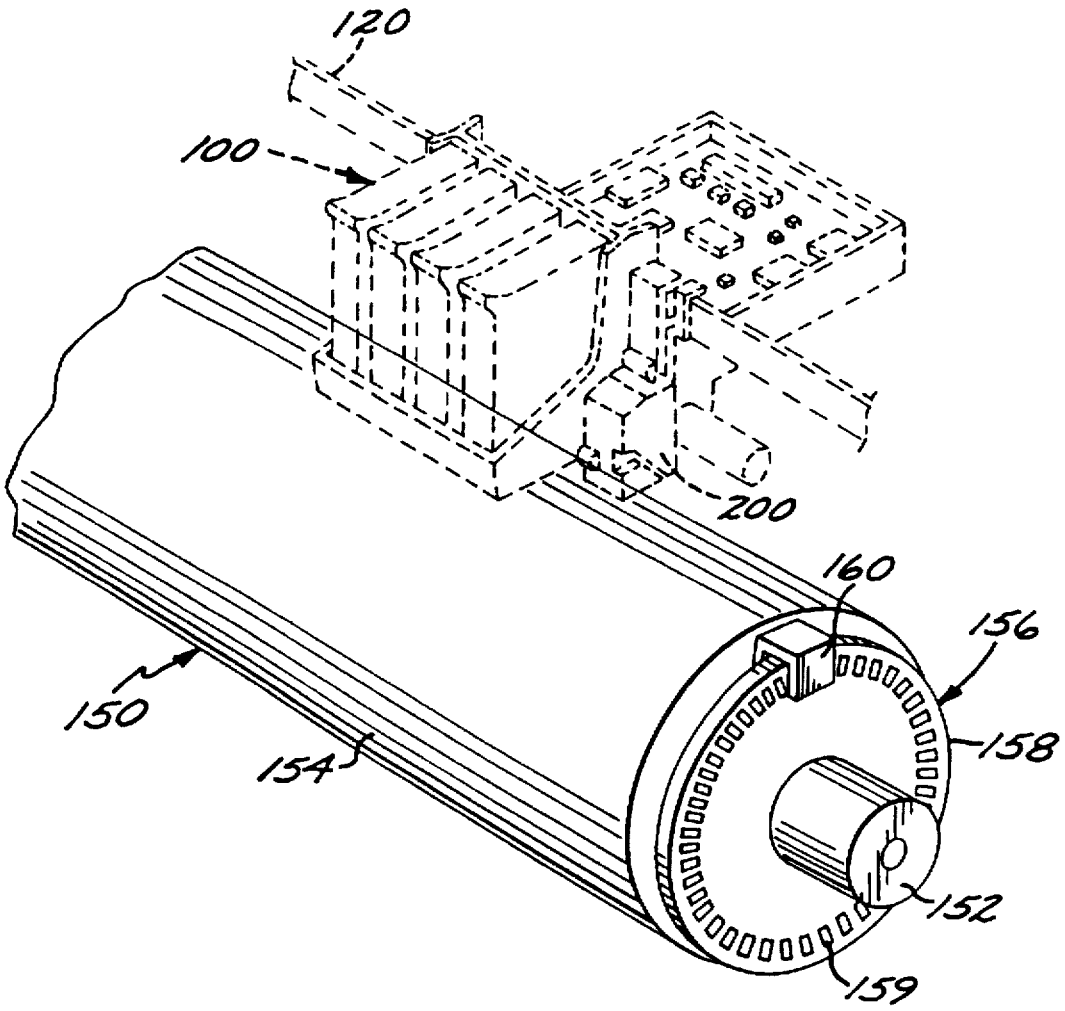
FIG. 3 is a simplified perspective view of a media positioning system of the print/plotter of FIG. 1.

FIG. 2 is a perspective view of the carriage assembly 100, the carriage positioning mechanism 110 and the encoder strip 120. The carriage positioning mechanism 110 includes a carriage position motor 112 which has a shaft 114 extending therefrom through which the motor drives a small belt 116. Through the small belt 116, the carriage position motor 112 drives an idler 122 via the shaft 118 thereof. In turn, the idler 122 drives a belt 124 which is secured by a second idler 126. The belt 124 is attached to carriage assembly 100 and adapted to slide therethrough.

The position of the carriage assembly 100 in the carriage axis is determined precisely by the use of the encoder strip 120. The encoder strip 120 is secured by a first stanchion 128 on one end and a second stanchion 129 on the other end. The encoder strip 120 may be implemented in a manner disclosed and claimed in commonly assigned U.S. Pat. No. 5,276,970, which is incorporated herein by reference. As disclosed in the reference, a carriage position encoder (not shown) having an optical reader is disposed on the carriage assembly and provides carriage position signals.

The carriage assembly 100 removably supports four ink jet printhead cartridges or pens 102, 104, 106, and 108 that store ink of different colors (e.g., black, yellow, magenta and cyan ink, respectively). As the carriage assembly 100 translates along the carriage scan axis, selected ink firing resistors of the printheads of the printhead cartridges 102, 104, 106 and 108 are activated such that ink drops are fired through associated ink jet nozzles.

FIG. 3 is a perspective view of a simplified representation of a media positioning system 150 utilized in the printer of FIG. 1. The media positioning system 150 includes a media axis motor 152 that drives the print roller 154. The position of the print roller 154 is determined by a media position encoder 156. The media position encoder 156 includes a disc having a plurality of apertures 159 therein an optical reader 160 provides a plurality of output pulses which facilitate the determination of the position of the print roller 154 and, therefore, the position of the print medium 30 as well. Position encoders are well known in the art. See for example, Economical High-Performance Optical Encoders by Howard C. Epstein et al., published in the Hewlett-Packard Journal, October 1988, pages 99–106.

As also shown in FIGS. 1, 2 and 3, an optical sensor module 200 is mounted on the carriage assembly 100. The sensor module optically senses test lines printed by a printhead to determine rotational misalignment of the printhead relative to the media advance axis as measured in a plane that contains the media advance axis and is parallel to the carriage axis. The angle of such rotational misalignment is referred to herein as the angle $\Theta_Z$. By way of illustrative example, the sensor module 200 is implemented with a phase plate, and suitable processing circuitry is provided for processing the output thereof, as disclosed in commonly assigned U.S. Pat. No. 5,404,020, incorporated herein by reference.

Figure 4:
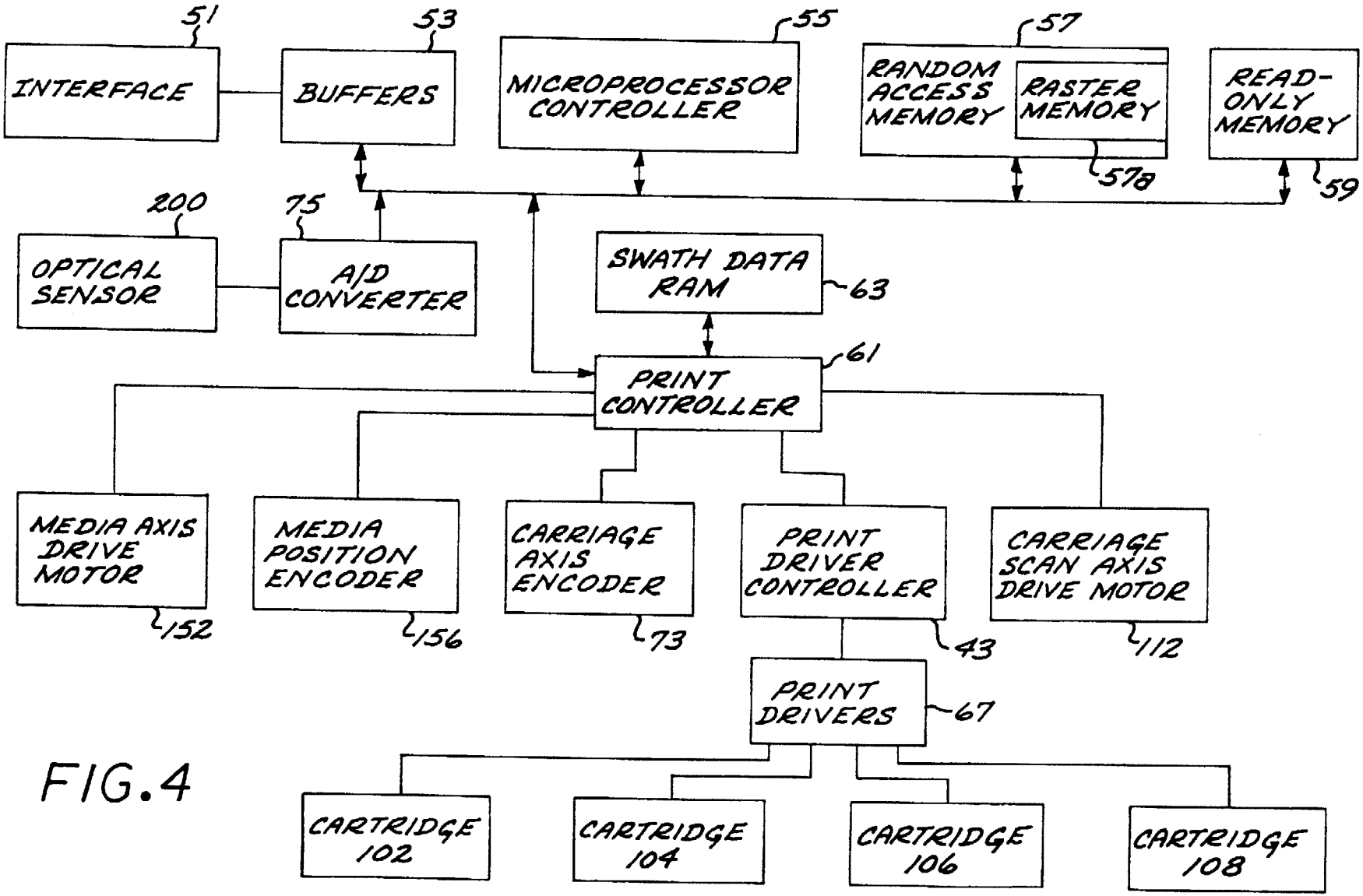
FIG. 4 is a simplified block diagram of a printer controller for controlling the swath printer of FIG. 1.

Referring now to FIG. 4, set forth therein is a simplified block diagram of a control system for controlling the thermal ink jet printer of FIG. 1 in which the techniques of the invention can be implemented. The control system includes an interface 51 which receives print data from a host computer, for example, and stores the print data in a buffer memory 53. A microprocessor controller 55 is configured to process the print data to produce raster data that is stored in a bit-map memory **57*a* contained in a random access memory (RAM) 57 provided for the use of the microprocessor controller 55. A read-only memory 59 is also provided as appropriate for the use of the microprocessor controller 55. Processes in accordance with the invention, as described further herein, can be performed by the microprocessor controller 55 in conjunction with processes contained in the read-only memory 59**.

A print controller 61 transfers portions of the raster data from the bit-map memory **57*a* to a swath memory 63 and provides swath data to a printhead driver controller 65 which controls printhead drivers 67 that drive the ink firing elements of the printhead cartridges 102, 104, 106, 108. The print controller 61 further controls the media axis drive motor 152 which moves the print roller 154 pursuant to media motion commands from the print controller 61. The media position encoder 156 provides information for the feedback control of the media axis drive motor 152. Similarly, a carriage axis encoder 73 provides feedback information for the feedback control of the carriage scan axis drive motor 112 which positions the ink jet cartridge supporting carriage assembly 100 pursuant to carriage motion commands from the print controller 61. A multichannel analog-to-digital (A/D) converter 75 receives analog signals based on the outputs of the optical sensor 200** and provides digital versions of such analog signals for processing to determine the rotational misalignment of a nozzle array.

Figure 5:
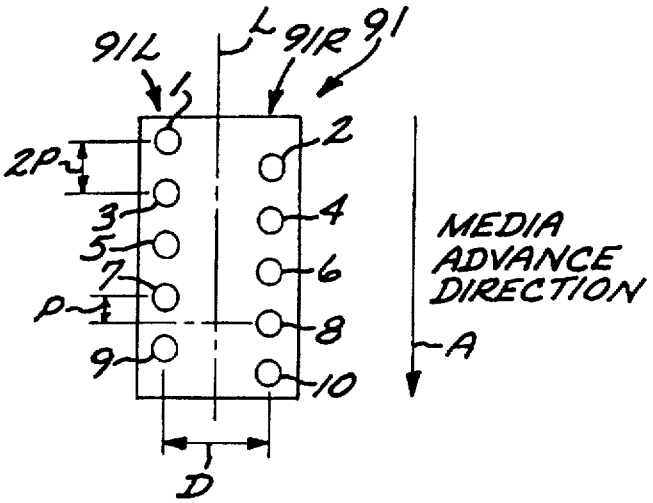
FIG. 5 is a schematic plan view illustrating a nozzle array of the printhead cartridge of the printer of FIG. 1.

Referring now to FIG. 5, illustrated therein is a schematic representation of a nozzle array 91 that is included in each of the printhead cartridges 102, 104, 106, 108, as viewed from above the nozzle array (i.e., the print media would be below the plane of the figure). The nozzle array 91 includes a plurality of nozzles arranged in a left column 91L and a right column 91R which are parallel to a nozzle array longitudinal axis L, wherein the nozzles of one column are staggered along the nozzle array longitudinal axis L. The distance along the nozzle array longitudinal axis L between diagonally adjacent nozzles, as indicated by the distance P in FIG. 5, is known as the nozzle pitch, and by way of example is equal to the dot pitch of the desired dot resolution (e.g., 1/600 inch for 600 dpi). The left and right columns 91L, 91R are separated by a column separation distance D, and in use the physical spacing between the columns is compensated by appropriate data shifts in the swath print data so that two columns function as a single column of nozzles. Ideally, the left and right nozzle columns 91L, 91R are parallel to a media advance axis A, as shown in FIG. 5, whereby the nozzle array longitudinal axis L is parallel to the media advance axis A. In practice, however, the nozzle columns 91L, 91R may not be parallel to the media axis, for example as a result of mechanical tolerances between the printhead cartridge and the print carriage, and thus would be only generally aligned with the media axis.

For reference, the nozzles of the nozzle columns are identified in sequence along the longitudinal axis L starting with the nozzle that would be first encountered by the print medium when advanced along the media axis direction, which is indicated by the arrowhead on the media advance axis A, when the nozzle columns are aligned with the media advance axis. Thus, for illustrative example shown in FIG. 5 wherein the nozzle that would be furthest along the media advance direction is the nozzle of the left column that is uppermost in the figure, such nozzle is nozzle 1 and the nozzles of the left nozzle column are identified by odd numbers. The nozzles of the right nozzle column are identified by even numbers starting with the nozzle of the right column that is uppermost in the figure.

Figure 6:
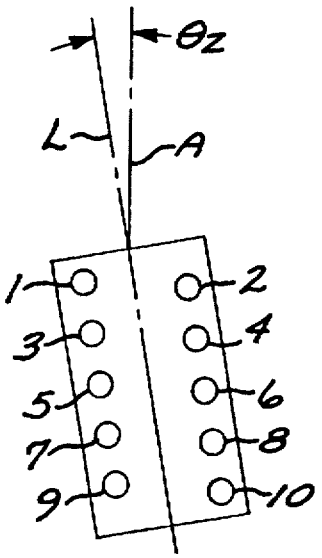
FIG. 6 schematically depicts a nozzle array that is rotationally misaligned in the counterclockwise direction relative to the media advance axis.
Figure 7:
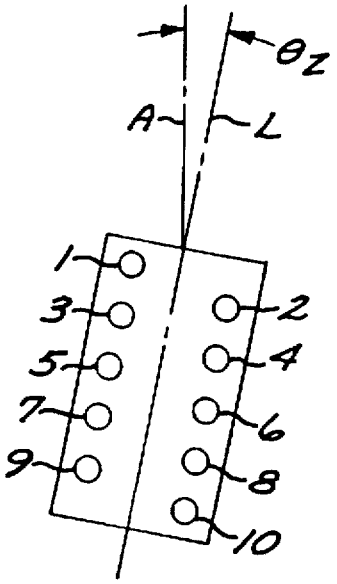
FIG. 7 schematically depicts a nozzle array that is rotationally misaligned in the clockwise direction relative to the media advance axis.

FIG. 6 schematically depicts a nozzle array that is rotationally misaligned in the counterclockwise direction relative to the media advance axis A, while FIG. 7 schematically depicts a nozzle array that is rotationally misaligned in the clockwise direction relative to the media advance axis A. The amount of rotational misalignment $\Theta_Z$ is relatively small, and thus the amount of error or misalignment along the media axis in the spacing between the left column nozzles and the right column nozzles is very closely approximated by ($D*\tan \Theta_Z$), wherein D is the distance between the left and right nozzle columns. This can be readily understood by visualizing the nozzle columns as being rotated about an axis that passes through a top or bottom nozzle of one of the nozzle columns. The other nozzle column is therefore displaced by an amount that is equal to ($D'*\tan \Theta_Z$), wherein D' is the projection on the carriage axis of the distance between nozzle columns. Since $\Theta_Z$ is relatively small, utilizing D instead of D' is reasonably accurate. For ease of reference, the rotational misalignment $\Theta_Z$ is always a positive angle regardless of the direction of the rotational misalignment. In this manner, the misalignment ($D*\tan \Theta_Z$) along the media axis in the spacing between the left column nozzles and the right column nozzles is always a positive number.

Generally in accordance with the invention, for each pen the amount and direction of the rotational misalignment $\Theta_Z$ are determined; a first swath is printed with one of the left and right nozzle columns; the print media is moved by a calculated media micro advance MA that is based on (a) the nozzle column that is selected to print a first swath, (b) the amount of the rotational misalignment $\Theta_Z$, and (c) the direction of the rotational misalignment $\Theta_Z$; and a second swath is printed with the other of the nozzle columns.

The rotational misalignment of a printhead can be generally determined as follows with an optical alignment system as disclosed in commonly assigned U.S. Pat. No. 5,404,020, incorporated herein by reference. Dots are printed with the nozzles of the printhead at a plurality of predetermined equidistant locations along the carriage axis, so as to produce a printed pattern of generally vertical line segments. An optical sensor that includes a phase plate is scanned across the top of the line segments. The output of the optical sensor comprises a sinewave which is digitized and processed to arrive at a first phase angle relative to a reference sinewave. The media is then advanced by a predetermined amount H, and the optical sensor is again scanned across the line segments. The output of the optical sensor is digitized and processed to arrive at a second phase angle relative to the reference sinewave. The first and second phase angles are converted to distances along the carriage axis, and the difference between the phase distances is calculated. Such difference is divided by the predetermined media advance H, and the arctan of the quotient provides the rotational misalignment.

Figure 8A:
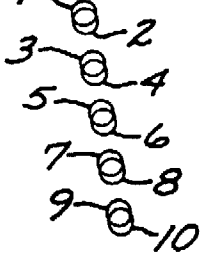
FIG. 8A schematically sets forth a dot pattern that would be printed at a fixed position along the carriage axis by the nozzles of the counterclockwise misaligned nozzle array of FIG. 6.

Referring now to FIG. 8A, schematically set forth therein is a dot pattern that would be printed at a fixed position along the carriage axis by the nozzles of the counterclockwise misaligned nozzle array shown in FIG. 5, wherein the printed dots are identified by the nozzle numbers of the nozzles by which they were produced. The dot placement errors due to misalignment along the carriage scan axis that are shown are compensated by appropriate swath data delays. Due to the counterclockwise rotational misalignment, the odd dots are displaced relative to the even dots along the media advance axis in the media advance direction.

In accordance with the invention, counterclockwise rotational misalignment can be compensated by printing dots with the left nozzle column in a first carriage scan, advancing the print media by an amount that is equal to or approximately equal to $2P-(D*\tan \Theta_Z)$, and printing dots with the right nozzle column in a second carriage scan. A resulting pattern of dots printed at a fixed swath position is shown in FIG. 8B. It is noted that the media advance of $2P-(D*\tan \Theta_Z)$ results in an interchange in the relative positions of the even dots and the odd dots, which is suitably compensated. Alternatively, dots are printed with the right nozzle column in a first carriage scan, the print media is advanced by an amount equal to or approximately equal to ($D*\tan \Theta_Z$), and dots are printed with the left nozzle column in a second carriage scan. A resulting pattern of dots printed at a fixed swath position is shown in FIG. 8C.

Figure 9A:
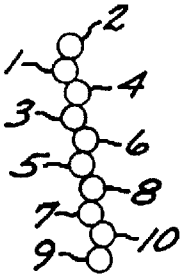
FIG. 9A schematically sets forth a dot pattern that would be printed in accordance with the invention at a fixed position along the carriage axis by the nozzles of the clockwise misaligned nozzle array of FIG. 7.
Figure 9A:
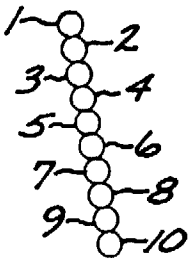
Figure 9A:
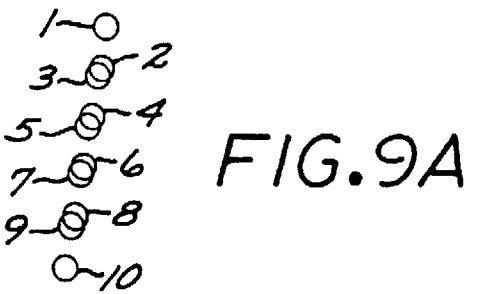

Referring now to FIG. 9A, set forth therein is a dot pattern than would be printed at a fixed position along the carriage axis by the clockwise misaligned nozzle array of FIG. 7, wherein the printed dots are identified by the nozzle numbers of the nozzles by which they were produced. The dot placement errors due to misalignment along the carriage scan axis that are shown are compensated by appropriate swath data delays. Due to the clockwise rotational misalignment, the even dots are displaced relative to the odd dots along the media advance axis in the media advance direction.

Figure 9B:
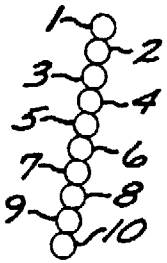
FIG. 9B schematically sets forth a dot pattern that would be printed in accordance with the invention at a fixed position along the carriage axis by the nozzles of the clockwise misaligned nozzle array as shown in FIG. 7.
Figure 9C:
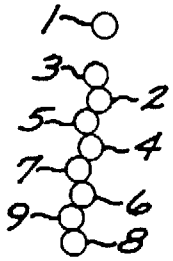
FIG. 9C schematically sets forth another dot pattern than would be printed in accordance with the invention at a fixed position along the carriage axis by the nozzles of the clockwise misaligned nozzle array of FIG. 7.

In accordance with the invention, clockwise rotational misalignment can be corrected by printing dots with the left nozzle column in a first carriage scan, advancing the print media by an amount equal to or approximately equal to ($D*\tan \Theta_Z$) and printing dots with the right nozzle column in a second carriage scan. A resulting pattern of dots printed at a fixed swath position is shown in FIG. 9B. Alternatively, dots are printed with the right nozzle column in a first carriage scan, the print media is advanced by an amount equal to or approximately equal to 2P–(D*tan $\Theta_Z$), and dots are printed with the left nozzle column in a second carriage scan. A resulting pattern of dots printed at a fixed swath position is shown in FIG. 9C. It is noted that the media advance of 2P–(D*tan $\Theta_Z$) results in an interchange in the relative positions of the even dots and the odd dots, which is appropriately compensated. It is further noted that the media advance of 2P–(D*tan $\Theta_Z$) results in dots printed by the first and last nozzles being separated from adjacent dots by distances that are greater than the print resolution dot pitch P. In use, the first and last nozzles are turned off, and the media advance after printing with both columns of the nozzle array is appropriately selected.

From the foregoing it should be appreciated that a given rotational misalignment can be corrected by (a) calculating a media micro advance MA that is equal to or approximately equal to (D*tan $\Theta_Z$) and determining which of the left and right nozzle columns prints first as a function of the direction of $\Theta_Z$, or (b) specifying that a certain one of the nozzle columns always prints first and calculating the media micro advance as a function of the direction of $\Theta_Z$, wherein the media micro advance is (D*tan $\Theta_Z$) or 2P–(D*tan $\Theta_Z$), depending on the direction of the rotational misalignment $\Theta_Z$.

Figure 10:
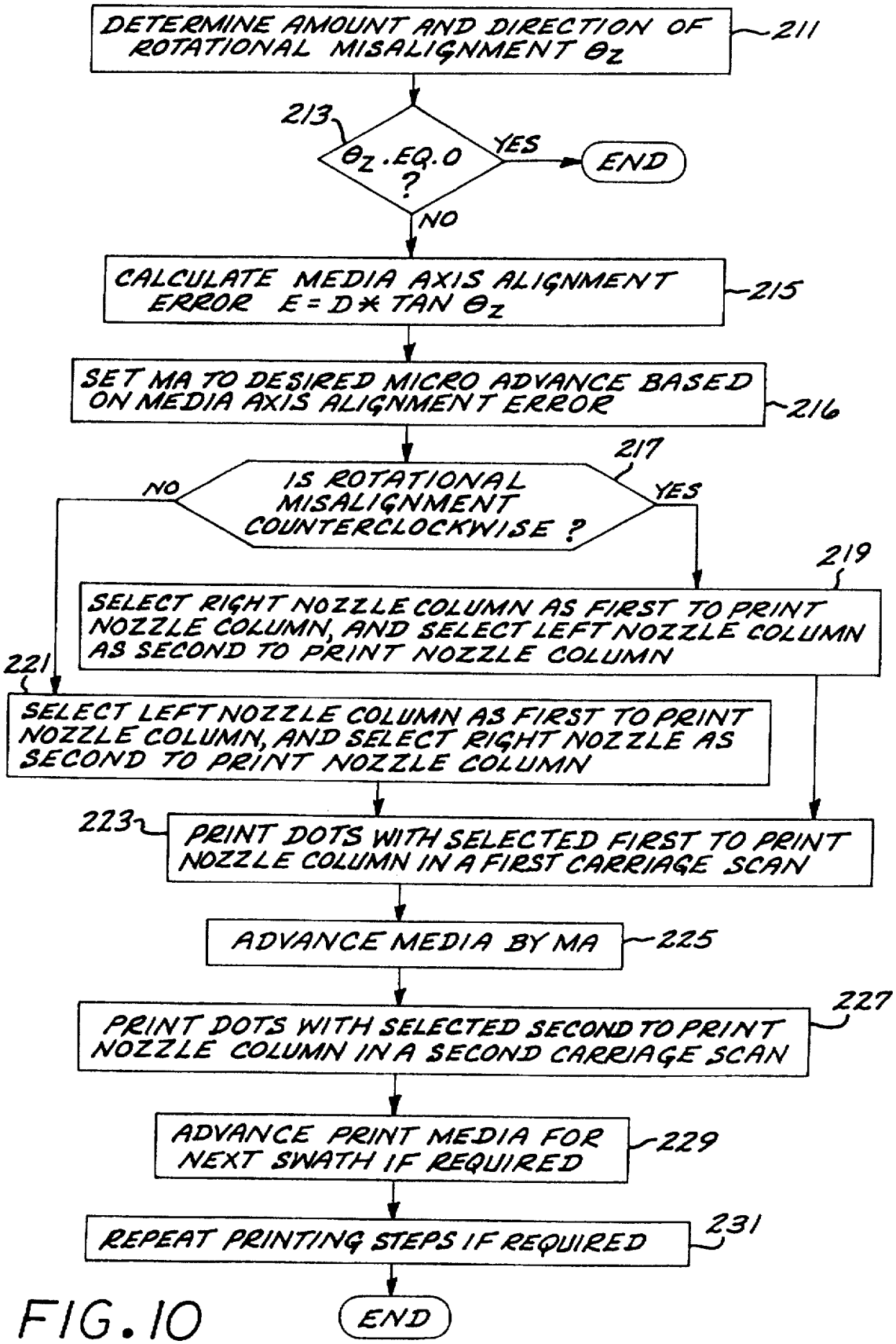
FIG. 10 sets forth a flow diagram of a printing procedure in accordance with the invention that compensates for media axis alignment error caused by rotational misalignment of a nozzle array.

Referring now to FIG. 10, set forth therein is a flow diagram of a rotational misalignment compensation for a single nozzle array that in accordance with the invention calculates a media micro advance MA that is equal to or approximately equal to the media axis alignment error (D*tan $\Theta_Z$), and determines which of the left and right nozzle columns prints first as a function of the direction of the rotational misalignment $\Theta_Z$. At 211 the amount and direction of the rotational misalignment $\Theta_Z$ is determined. At 213 a determination is made as to whether $\Theta_Z$ is equal to 0. If yes, the procedure ends and printing is performed without rotational misalignment compensation. If the determination at 213 is no, at 215 a media axis alignment error E is set to (D*tan $\Theta_Z$). At 216 a media micro advance MA is determined on the basis of the media axis alignment error E. For example, the media micro advance can be set equal to the media axis alignment error E. Alternatively, the media micro advance can be set to be approximately equal to the media axis alignment error (D*tan $\Theta_Z$). For example, the media micro advance can be set to the ¼ dot pitch increment that is closest to the media axis alignment error (i.e., ¼P, ½P, or ¾P). At 217 a determination is made as to whether the rotational misalignment is counterclockwise. If yes, at 219 the right nozzle column is selected as the first to print nozzle column, and left nozzle column is selected as the second to print nozzle column. Control then transfers to 223. If the determination at 217 is no, at 221 the left nozzle column is selected as the first to print nozzle column, and the right nozzle column is selected as the second to print nozzle column. At 223 dots are printed with the selected first to print nozzle column in a first carriage scan, and at 225 the print media is advanced by the micro advance MA. At 227 dots are printed with the selected second to print nozzle column in a second carriage scan. At 229 the print media is advanced for the next swath if required, and at 231 the steps of printing are repeated if required.

Figure 11:
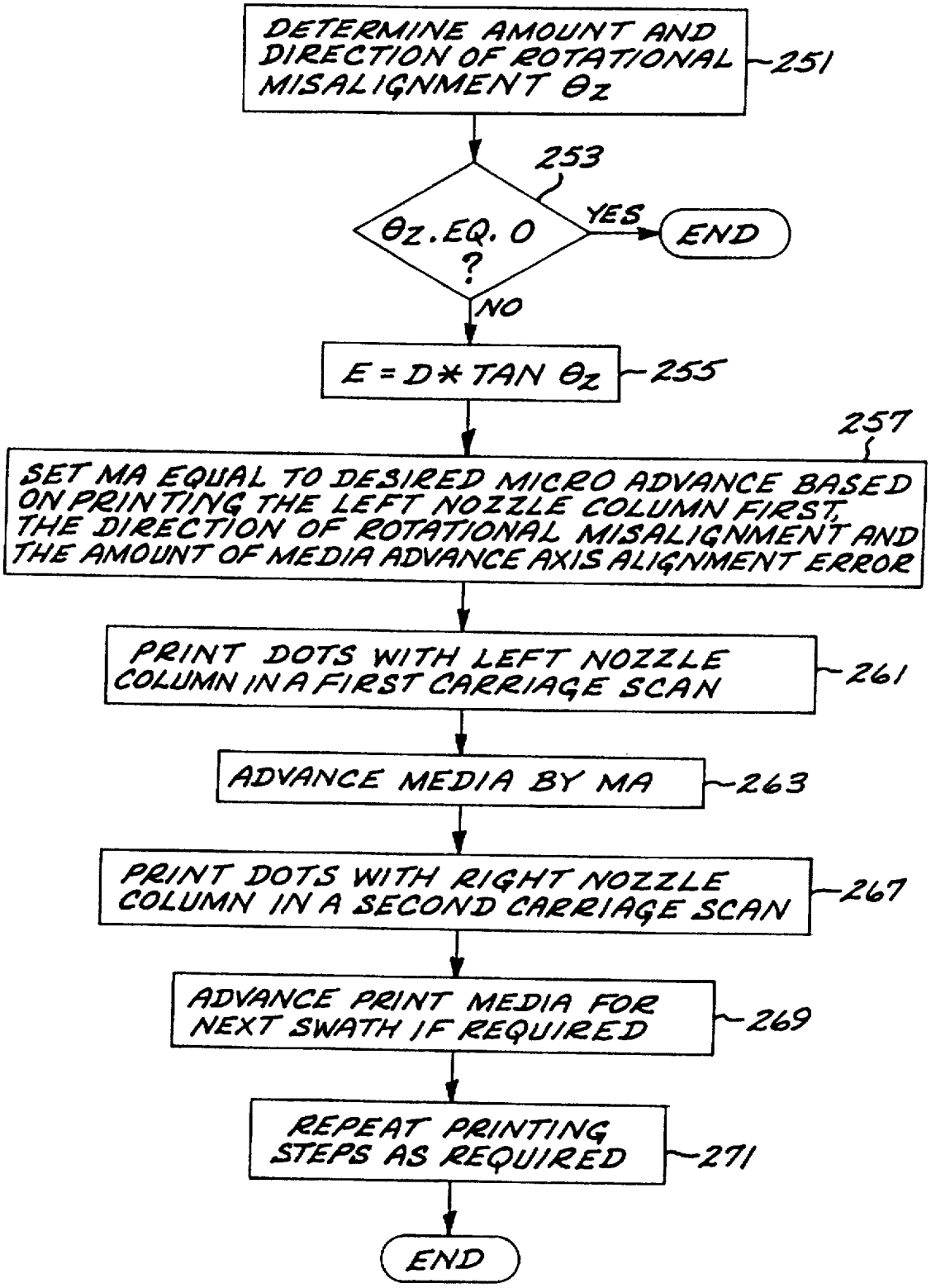
FIG. 11 sets forth a flow diagram of another printing procedure in accordance with the invention that compensates for media axis alignment error caused by rotational misalignment of a nozzle array.

Referring now to FIG. 11, set forth therein is a flow diagram of a rotational misalignment compensation for a single nozzle array that in accordance with the invention prints first with the left nozzle column and moves the print media by a micro advance that is a function of the direction and amount of the rotational misalignment $\Theta_Z$. At 251 the amount and direction of rotational misalignment $\Theta_Z$ is determined. At 253 a determination is made as to whether the rotational misalignment $\Theta_Z$ is equal to zero. If yes, the procedure ends and printing is performed without rotational misalignment compensation. If the determination at 253 is no, at 255 a media axis alignment error E is set to (D*tan $\Theta_Z$). At 257 a media micro advance MA is determined on the basis of the pre-selection of the left nozzle column as the first to print nozzle column, the direction of the rotational misalignment, and the media axis alignment error E. In particular, if the rotational misalignment is counterclockwise, the media micro advance can be set equal to 2P–(D*tan $\Theta_Z$). Alternatively, the media micro advance MA can be set to be approximately equal to 2P–(D*tan $\Theta_Z$). For example, the media micro advance MA can be set to the ¼ dot pitch increment that is closest to 2P–(D*tan $\Theta_Z$); (i.e., 2P-¾P, 2P-½P, or 2P-¼P) . If the rotational misalignment is clockwise, the media micro advance can be set equal to the media axis alignment error E. Alternatively, the media micro advance can be set to be approximately equal to the ¼ dot pitch increment that is closest to the media axis alignment error E (i.e., ¼P, ½P, or ¾P). At 261 dots are printed with the left nozzle column in a first carriage scan, and at 263 the print media is advanced by the micro advance MA. At 265 dots are printed with the right nozzle column in a second carriage scan. At 267 the print media is advanced for the next swath if required, and at 269 the steps of printing are repeated if required.

Figure 12:
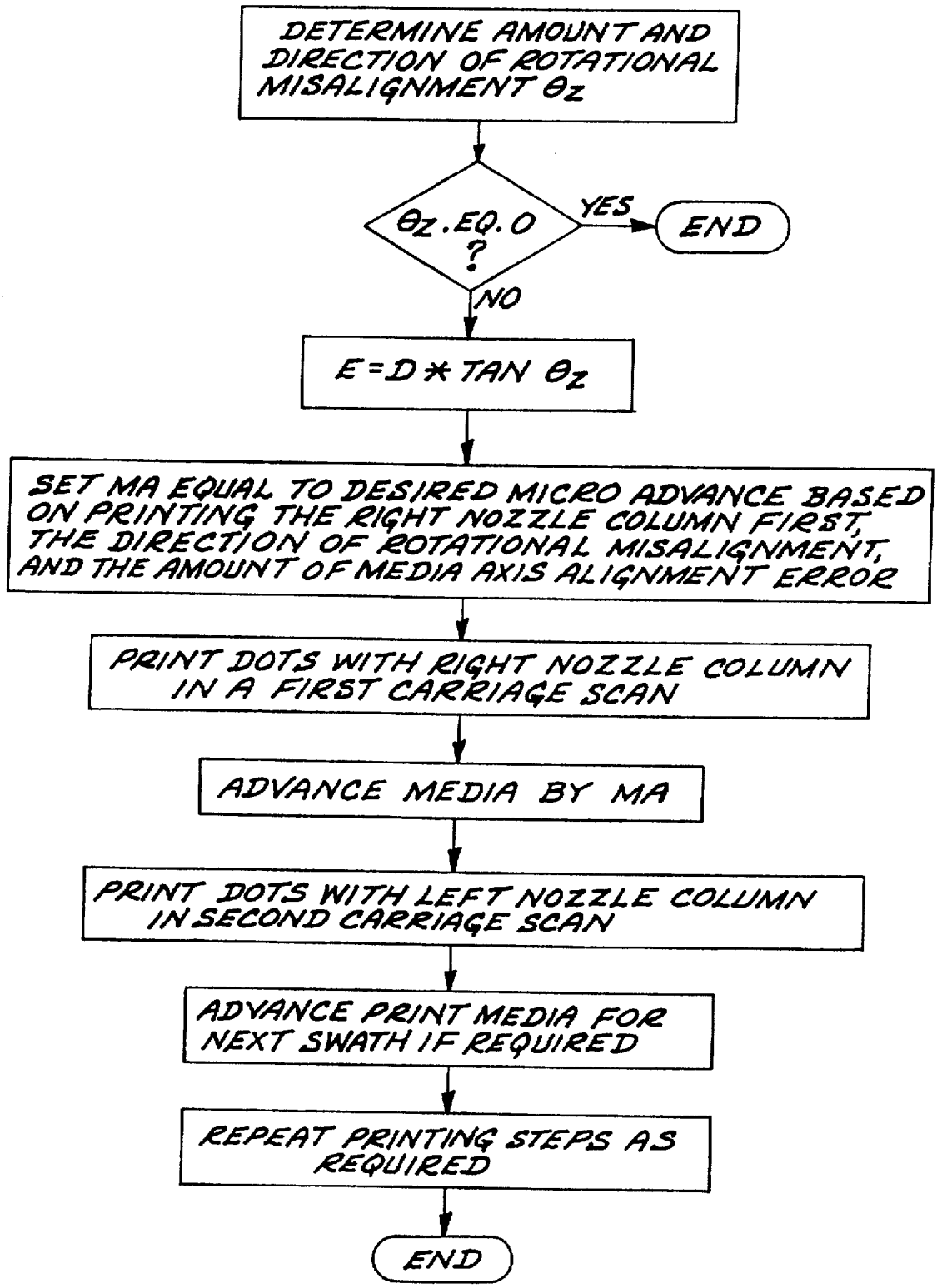
FIG. 12 sets forth a flow diagram of a further printing procedure in accordance with the invention that compensates for media axis alignment error caused by rotational misalignment of a nozzle array.

FIG. 12 sets forth a flow diagram of a procedure similar to that of FIG. 11, except that dots are first printed with the right nozzle column prior to advancing the print media by a micro advance that is a function of the direction of the rotational misalignment $\Theta_Z$. The steps of FIG. 12 are believed to be self-explanatory, particularly in view of the flow diagram of FIG. 11, and thus a detailed discussion of the procedure of FIG. 12 will not be provided herein. It should be appreciated as to calculating the media micro advance MA that since the right nozzle column is to be printed first, if the rotational misalignment is counterclockwise, the media micro advance MA is set equal to the media axis alignment error E, or approximately equal to the media axis alignment error E. If the rotational misalignment is clockwise, the media micro advance MA is set equal to 2P–(D*tan $\Theta_Z$), or approximately equal to 2P–(D*tan $\Theta_Z$). Also, if the rotational misalignment is clockwise, the first and last nozzles of the nozzle array are turned off, and the swath height is reduced to N-2 dot pitches for a nozzle array having N nozzles.

The procedures of FIGS. 10–12 have been directed to compensation of rotational misalignment for a single pen. Compensation of rotational misalignments for a plurality of pens as shown in FIG. 1 can be achieved in various ways. A straightforward technique would be to consider each pen independently and determine for each pen which compensation technique is to be utilized. Then, dots are printed with the first to print nozzle columns of all pens. The print media is then advanced by the smallest of the calculated media micro advances, and dots are printed in a second carriage scan with the second to print nozzle column of the pen having the smallest of the calculated media micro advances. The print media is then advanced by an amount such that the total media advance since the first carriage scan is equal to the next smallest calculated micro advance, and dots are printed in a third carriage scan with the second to print nozzle column of the pen having the next smallest calculated media micro advances. The process then continues for the remaining pens in order of increasing calculated micro advances.

Figure 13:
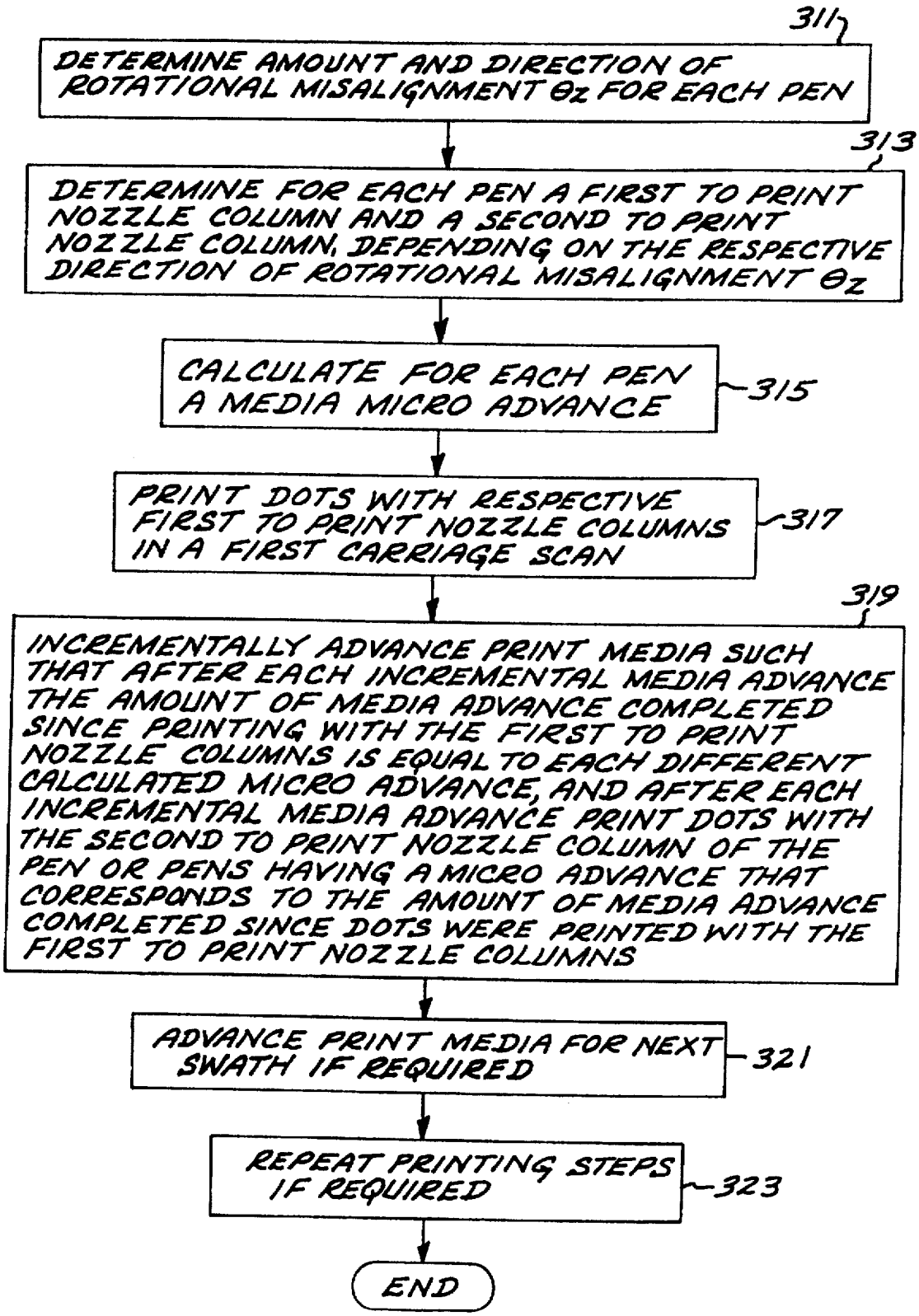
FIG. 13 sets forth a flow diagram of a procedure in accordance with the invention that compensates for media axis alignment error caused by rotational misalignment of a plurality of nozzle arrays.

Referring now to FIG. 13, set forth therein is a flow diagram of a procedure for compensating rotational misalignments for a plurality of pens that for each pen calculates a media micro advance as in the procedure of FIG. 10, prints with the first to print nozzle columns of all pens, and then iteratively advances the print media and prints dots with the second to print nozzle columns in accordance with increasing respective calculated media micro advances. At 311 the amount and direction of rotational misalignment $\Theta_Z$ is determined for each pen. At 313 a first to print nozzle column and a second to print nozzle column is determined for each pen, depending on the respective direction of rotational misalignment $\Theta_Z$, as determined in the procedure of FIG. 10 for a single pen. At 315 the respective media axis alignment errors are calculated for each of the pens in form of ($D^*\tan \Theta_Z$) as calculated in the procedure of FIG. 10 for a single pen. At 317 dots are printed in a first carriage scan with respective first to print nozzle columns. At 319 the print media is advanced incrementally such that after each incremental media advance the amount of media advance completed since printing with first to print nozzle columns is equal to each different calculated micro advance, and after each incremental media advance dots are printed with the second to print nozzle column of the pen or pens having a micro advance that corresponds to the amount of media advance completed since dots were printed with the first to print nozzle columns. For example, if two pens have a calculated micro advance of ¼P, one pen has a calculated micro advance of ½P, and another pen has a calculated micro advance of ¾P, the media is advanced by ¼P and the dots are printed with the second to print nozzle columns of the two pens having a calculated micro advance of ¼P. The media is then advanced by ¼P and dots are printed with the second to print nozzle column of the pen having a calculated micro advance of ½P. The media is advanced another ¼P and dots are printed with the second to print nozzle column of the pen having a calculated micro advance of ¾P. In other words, for each different calculated micro advance, the media is incrementally advanced such that after each incremental advance the media advance completed is equal to such different calculated micro advances. After each incremental media advance, the second to print nozzle column of the pen or pens having a calculated micro advance that corresponds to the amount of media advance completed since the printing with the first to print nozzle columns. At 321 the print media is advanced for the next swath if required, and at 323 the steps of printing steps are repeated if required.

Relative to the procedure of FIG. 13, it should be appreciated that the media micro advances can be approximated to integral multiples of a fractional dot fraction such as ¼ dot pitch, whereby the number of micro advances of the print media would be reduced if the media axis alignment errors are close in value.

In the foregoing printing procedures, the compensating media micro advances have been in the media advance direction to avoid mechanical backlash errors. Thus, in certain procedures the relative positions of the left nozzles and the right nozzles are interchanged. However, it should be appreciated that the relative positions of the left nozzles and right nozzles can be maintained by making the media micro advance negative where a positive media micro advance would result in an interchange of the relative positions of the left nozzles and right nozzles. Such negative media micro advance would be equal to or approximately equal to $-(D^*\tan \Theta_Z)$. Thus, for a counterclockwise rotation misalignment wherein the left nozzle column is to be printed first, dots are printed with the left nozzle column, the media is moved by a micro advance that is approximately equal to $-(D^*\tan \Theta_Z)$ (i.e., in the direction opposite the media advance direction), and dots are printed with the right nozzle column. The media advance after printing with the right nozzle column would be the swath height plus the absolute value of the media micro advance. Analogously, for a clockwise rotation misalignment wherein the right nozzle column is to be printed first, dots are printed with the right nozzle column, the media is moved by a micro advance that is approximately equal to $-(D^*\tan \Theta_Z)$, and dots are printed with the left nozzle column. The media advance after printing with the left nozzle column would be the swath height plus the absolute value of the media micro advance.

The foregoing has thus been a disclosure of techniques for compensating microbanding that results from rotational misalignment of an ink jet nozzle array relative to the media advance axis.

Although the foregoing has been a description and illustration of specific embodiments of the invention, various modifications and changes thereto can be made by persons skilled in the art without departing from the scope and spirit of the invention as defined by the following claims.

What is claimed is:

1. A method for ink jet printing with an ink jet printhead supported by carriage that is movable along a carriage axis, the ink let printhead having a left nozzle column and a right nozzle column that are parallel to a longitudinal axis, spaced apart by a distance D, and generally aligned with a media advance axis and having a rotational misalignment relative to the media advance axis, wherein the left nozzle column includes a plurality of nozzles spaced apart by a distance 2P and the right nozzle column includes a plurality of nozzles spaced apart by 2P, wherein the nozzles of the left nozzle column are staggered along the longitudinal axis relative to the nozzles of the right nozzle column such that the distance along the longitudinal axis between diagonally adjacent nozzles is P, and wherein the nozzles of the left nozzle column and the nozzles of the right nozzle column are in a sequence of a first nozzle through Nth nozzle and a print medium first encounters the first nozzle when the print medium is advanced in a media advance direction, the method comprising the steps of:

determining an amount of the rotational misalignment of the left nozzle column and the right nozzle column relative to the media scan axis, and a direction of the rotational misalignment;

selecting one of the left nozzle column and the right nozzle column as a first to print nozzle column;

determining a media advance correction to compensate the rotational misalignment;

printing dots on the print medium with the first to print nozzle column in a first carriage scan of the carriage alone the carriage axis;

moving the print medium by the media advance correction; and printing dots on the print medium with another of the left nozzle column and the right nozzle column in a second carriage scan of the carriage along the carriage axis.

2. The method of claim 1 wherein:

the step of determining a media advance correction comprises the step of setting a media advance correction to approximately ($D^*\tan \Theta_Z$), wherein $\Theta_Z$ is the amount of rotational misalignment; and the step of selecting the first to print nozzle column comprises the step of selecting the right nozzle column as the first to print nozzle column if the rotational misalignment is counterclockwise, and selecting the left nozzle column as the first to print nozzle column if the rotational misalignment is clockwise.

3. The method of claim 1 wherein:

the step of determining a media advance correction comprises the step of setting a media advance correction to (a) approximately $2P-(D*\tan \Theta_Z)$ if the rotational misalignment is counterclockwise, and (b) approximately $(D*\tan \Theta_Z)$ if the rotational misalignment is clockwise, wherein $\Theta_Z$ is the amount of rotational misalignment; and the step of selecting a first to print nozzle column comprises the step of selecting the left nozzle column as a first to print nozzle column.

4. The method of claim 1 wherein:

the step of determining a media advance correction comprises the step of setting a media advance correction to (a) approximately $(D*\tan \Theta_Z)$ if the rotational misalignment is counterclockwise, and (b) approximately $2P-(D*\tan \Theta_Z)$ if the rotational misalignment is clockwise, wherein $\Theta_Z$ is the amount of rotational misalignment; and the step of selecting a first to print nozzle column comprises the step of selecting the right nozzle column as a first to print nozzle column.

5. The method of claim 1 wherein:

the step of determining a media advance correction comprises the step of setting a media advance correction to (a) approximately $-(D*\tan \Theta_Z)$ if the rotational misalignment is counterclockwise, and (b) approximately $(D*\tan \Theta_Z)$ if the rotational misalignment is clockwise, wherein $\Theta_Z$ is the amount of rotational misalignment; and the step of selecting a first to print nozzle column comprises the step of selecting the left nozzle column as a first to print nozzle column.

6. The method of claim 1 wherein:

the step of determining a media advance correction comprises the step of setting a media advance correction to (a) approximately $(D*\tan \Theta_Z)$ if the rotational misalignment is counterclockwise, or (b) approximately $-(D*\tan \Theta_Z)$ if the rotational misalignment is clockwise, wherein $\Theta_Z$ is the amount of rotational misalignment; and the step of selecting a first to print nozzle column comprises the step of selecting the right nozzle column as a first to print nozzle column.

* * * * *